US005341647A

United States Patent [19]

Koeberle et al.

[11] Patent Number: 5,341,647

[45] Date of Patent: Aug. 30, 1994

[54] PORCESS AND APPARATUS FOR THE PRODUCTION OF HIGH PRESSURE NITROGEN AND OXYGEN

[75] Inventors: Yves Koeberle, Le Perreux sur Marne; Jean-Pierre Tranier, Villejuif, both of France

[73] Assignee: L'Air Liquide, Societe Anonyme pour l'Etude et l'Exploitation des Procedes Georges Claude, Paris, France

[21] Appl. No.: 27,788

[22] Filed: Mar. 8, 1993

[30] Foreign Application Priority Data

Mar. 24, 1992 [FR] France ..... 92 03501

[51] Int. Cl.[5] ..... F25J 3/00

[52] U.S. Cl. ..... 62/39; 62/41

[58] Field of Search ..... 62/24, 39, 41

[56] References Cited

U.S. PATENT DOCUMENTS 2,982,108 5/1961 Grunberg et al. ..... 62/28
3,123,457 3/1964 Smith ..... 62/41
3,214,925 11/1965 Becker ..... 62/41
3,401,531 9/1968 Kessler et al. ..... 62/20
4,869,741 9/1989 McGuinness et al. ..... 62/24

FOREIGN PATENT DOCUMENTS 0042676 12/1981 European Pat. Off. .

*Primary Examiner*—Ronald C. Capossela
*Attorney, Agent, or Firm*—Curtis, Morris & Safford

[57] ABSTRACT

According to the process of the invention, after heating, nitrogen which exits from a pressure column is compressed under elevated pressure by means of a single nitrogen compressor, and the low pressure column is operated at a pressure of about $P_N/\rho_N$, where $P_N$ represents the elevated pressure of nitrogen and $\rho_N$ the compression ratio of the nitrogen compressor. Application to the simultaneous production on the one hand of high purity nitrogen at a pressure between 50 and 60 bars, and on the other hand, of oxygen at 65 bars, so as to supply a unit for the production of ammonia.

11 Claims, 1 Drawing Sheet

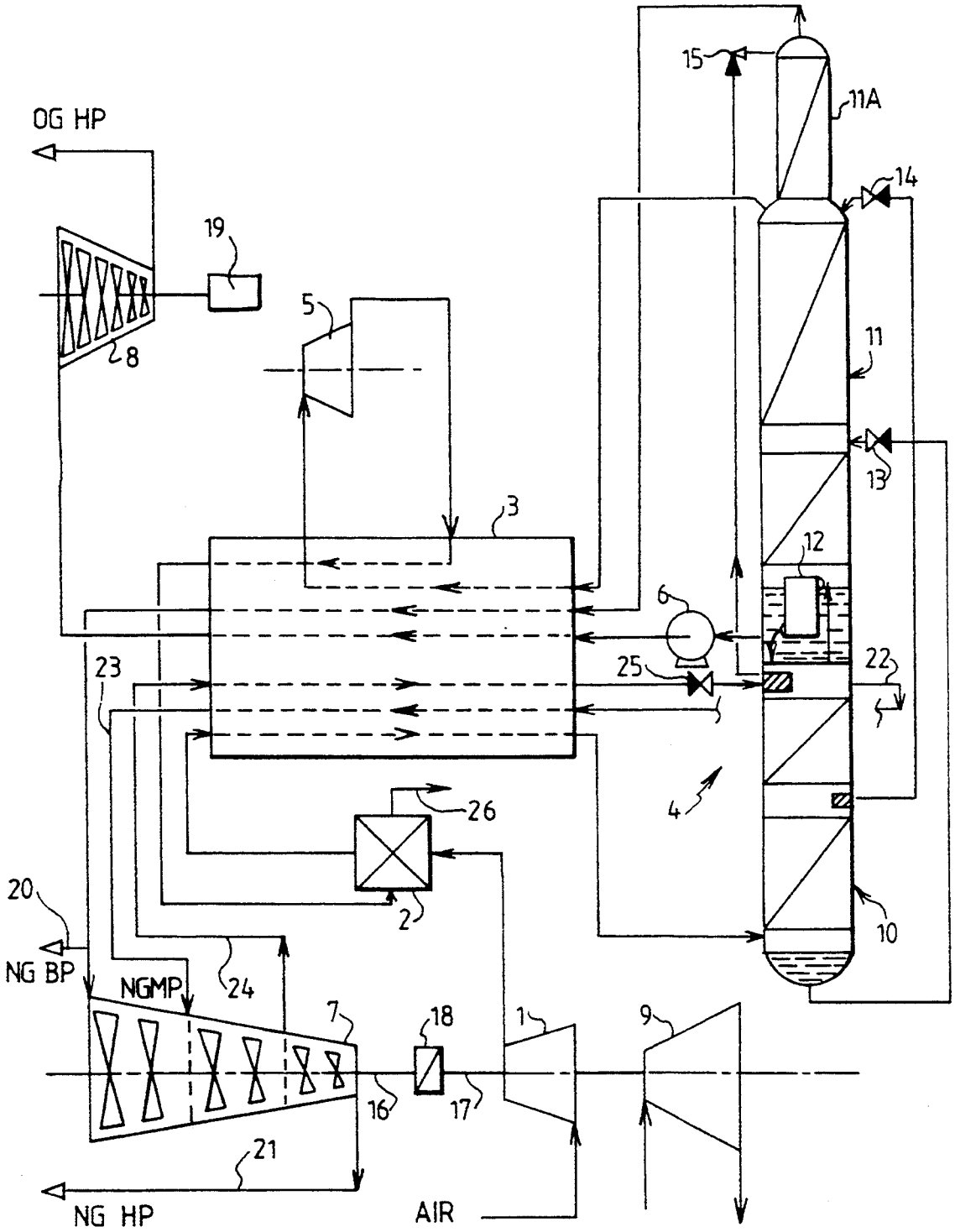
OG HP
19
8
5
3
15
11A
14
11
13
12
6
25
22
23
4
26
2
10
20
NG BP
NGMP
24
7
18
1
9
16
17
21
NG HP
AIR

PORCESS AND APPARATUS FOR THE PRODUCTION OF HIGH PRESSURE NITROGEN AND OXYGEN

BACKGROUND OF INVENTION

Field of the Invention

The present invention relates to the production of nitrogen and oxygen by air distillation. It concerns, first, a process for the simultaneous production, on the one hand, of pure nitrogen under an elevated pressure of nitrogen which is higher than about 25 bars absolute, and on the other hand, of oxygen, by air distillation in a double distillation column comprising a mean pressure column and a low pressure column of the "minaret" type which produces pure nitrogen in the top portion thereof.

A specific application of the invention is the simultaneous production on the one hand of high purity nitrogen, containing less than 10 ppm oxygen, in large quantity (i.e. representing at least 20% and typically more than 30% of the flow of air being treated), at 50 to 60 bars, intended for a unit for the production of ammonia, and, on the other hand, of oxygen of an average to high purity, that is 95 to 99.5% in moles, at a pressure of about 65 bars and with an elevated yield of extraction, for the production of hydrogen by reaction of oxygen with heavy hydrocarbons, the hydrogen being intended to supply the same unit for the production of ammonia.

The term "low pressure column of the minaret type" means a low pressure column, which is part of a double column for air distillation, in which the upper end portion is supplied at the top with "upper poor liquid" (substantially pure nitrogen) which is withdrawn at the top of the mean pressure column and is thereafter expanded, and which produces, at the top, pure nitrogen under low pressure.

The pressures referred to herein are absolute pressures. Moreover, the term "low pressure" and "mean pressure" mean operating pressures of the low pressure column and of the mean pressure column of the double column, respectively.

The invention aims at providing a process enabling the production, in addition to oxygen, of nitrogen under elevated pressure, in large amounts, i.e. representing at least 20% of the flow of air being treated, with a reduced investment.

SUMMARY OF INVENTION

For this purpose, the process according to the invention is characterized in that after heating, nitrogen which exits from the low pressure column is compressed at an elevated pressure by means of a single nitrogen compressor of the centrifugal type having at most six compression wheels and the low pressure column is operated at a pressure of the order of $P_N/\rho_N$ where $P_N$ represents the elevated pressure of nitrogen and $\rho_N$ the compression ratio of said nitrogen compressor.

According to other characteristics:

when oxygen is produced under an elevated pressure of oxygen which is higher than about 10 bars absolute, advantageously, liquid oxygen which is withdrawn at the bottom of the low pressure column is brought by means of a pump at an intermediate pressure of oxygen, and after vaporizing and heating oxygen, the latter is compressed at an elevated pressure of oxygen by means of a single compressor of oxygen of the centrifugal type having at most six compression wheels, the intermediate pressure of oxygen being of the order of $P_o/\rho_o$, where $P_o$ represents the elevated pressure of oxygen and $\rho_o$ is the compression ratio of said oxygen compressor;

in this case, preferably:

there is used a three stage nitrogen compressor, each stage having at most two wheels, and additionally the second stage is used to compress at an intermediate pressure between the mean pressure and the elevated pressure, a flow of cycle nitrogen which is withdrawn from the mean pressure column and is heated, the compressed cycle nitrogen being cooled, liquefied, expanded at mean pressure and introduced at the top of the mean pressure column;

the cycle nitrogen is compressed at a sub-critical pressure at which the condensation temperature of nitrogen is slightly higher than the vaporization temperature of oxygen under said intermediate pressure of oxygen.

According to yet other characteristics:

there is used a three stage nitrogen compressor each having at most two wheels, and additionally, the first two stages are used to compress from the low pressure to an intermediate pressure between the mean pressure and the elevated pressure, a flow of nitrogen, known as the rectification support, which is withdrawn at the top of the low pressure column and is heated, this compressed nitrogen being cooled, liquefied, expanded at the mean pressure and introduced at the top of the mean pressure column;

the apparatus for air distillation is kept under cold conditions by expanding impure nitrogen which is withdrawn from the low pressure column in a turbine, this impure nitrogen, after expansion and heating, being preferably used to regenerate bottles of adsorbent material which are used for purifying air being treated.

It is also an object of the invention to provide an apparatus for carrying out such process. This apparatus comprises an air compressor adapted for bringing air to be treated at a mean pressure higher than 6 bars absolute, and a single nitrogen compressor body of the centrifugal type having at most six compression wheels and in which the suction of the first wheel is connected to the top of the minaret of the low pressure column, this column operating under a low pressure of the order of $P_N/\rho_N$, where $P_N$ represents the elevated pressure of nitrogen and $\rho_N$ the compression ratio of said nitrogen compressor.

In particular, the nitrogen compressor and the air compressor may be connected to a common power source.

BRIEF DESCRIPTION OF DRAWINGS

An embodiment of the invention will now be described with reference to the annexed drawing, in which:

the single FIGURE is a schematic representation of an apparatus for the simultaneous production of nitrogen and oxygen under elevated pressure, according to the invention.

DESCRIPTION OF PREFERRED EMBODIMENTS

The apparatus which is illustrated in the drawings is intended to produce on the one hand, under 55 bars, gaseous nitrogen of high purity (typically containing less than 10 ppm oxygen), at a flow at least equal to 20% of the flow of air being treated, and on the other hand, under 65 bars, oxygen at a purity of 95 to 99.5%, with a high yield of extraction. These two gases under elevated pressure will be used on a same site: hydrogen will be produced by reacting oxygen with heavy hydrocarbons, and this hydrogen will be reacted with nitrogen to give ammonia.

The apparatus essentially comprises an air compressor 1, a device 2 for purifying air by adsorption, a heat exchange line 3 of the counter-current type, a double distillation column 4, an expansion turbine 5, a pump for liquid oxygen 6, a nitrogen compressor 7, an oxygen compressor 8 and a source of power 9 consisting for example of a steam turbine.

Double column 4 comprises a mean pressure column 10 surmounted by a low pressure column 11 in which the upper end portion defines a minaret 11A for the production of pure nitrogen under low pressure. A condensor-vaporizer 12 sets up heat exchange relationship between the head vapor (substantially pure nitrogen) of column 10 and the vat liquid (oxygen of given purity) of column 11.

In known manner, a duct provided with an expansion valve 13 enables to cause "rich liquid" (oxygen enriched air) to rise from the bottom of column 10 to an intermediate point of column 11; a duct provided with an expansion valve 14 enables to cause "lower poor liquid" (impure nitrogen) to rise from an intermediate point of column 10 to the base of minaret 11A; and a duct provided with an expansion valve 15 enables to cause "upper poor liquid" (substantially pure nitrogen) to rise from the top column 10 to the top of the minaret.

The nitrogen compressor 7 consists of a single three stage compressor. The first two stages each comprise two compression wheels and have average compression ratios per wheel of 2 and 1.73 respectively, while the third stage comprises a single compression wheel having a compression ratio of 1.83. The global compression ratio of the compressor is therefore 22. Each wheel has a refrigerating agent at its outlet.

The oxygen compressor 8 also consists of a single compressor. This compressor has six wheels having an average compression ratio of 1.37 per wheel. The global compression ratio is therefore 6.5.

The shaft 16 of compressor 7 is connected to shaft 17 of compressor 1 by means of a coupling 18, and the unit is operated by the common source of energy 9. Possibly, shaft 16 may drive the different stages of compressor 7 by means of speed multipliers which are suitable for each stage. Compressor 8 is driven by a separate source of energy 19.

The low pressure is selected so that once multiplied by the compression ratio of compressor 7, it provides the desired elevated pressure for the production of nitrogen. Thus, by neglecting the losses of charge, for an elevated pressure of nitrogen of 55 bars, the chosen low pressure is $55/22=2.5$ bars. For a temperature spread of 2° C. in the vaporizer-condensor 12, this corresponds to a mean pressure of the order of 11 bars.

Thus, the air which is introduced is compressed at 11 bars in compressor 1, it is purified at 2, cooled from the hot end to the cold end of the heat exchange line 3, and introduced in the vicinity of its dew point at the bottom of column 10. The pure low pressure nitrogen which exits in gas form from the top of minaret 11A and which is heated at room temperature from the cold end to the hot end of the heat exchange line, is introduced at the suction side of the first stage of compressor 7, except possibly for a flow of nitrogen produced at low pressure via duct 20. The high pressure nitrogen is produced by compression in the third stage of the compressor and is removed via duct 21.

Compressor 7 is also used as a compressor for cycle nitrogen. For this purpose, mean pressure nitrogen is withdrawn at the top of column 10, via duct 22, is heated at room temperature in the heat exchange line and is introduced via duct 23 at the suction side of the second stage of compressor 7. High pressure cycle nitrogen exits after being compressed in this second stage via duct 24, it is cooled, liquefied, and sub-cooled in the heat exchange line, expanded at mean pressure in an expansion valve 25 and is introduced at the top of column 10.

Through flow control means not illustrated, the flow of nitrogen which circulates in duct 24 is higher by a given quantity than the flow of nitrogen which circulates in duct 23. The difference constitutes an additional flow of liquid nitrogen, so called rectification support, which is introduced under reflux at the top of column 10. This flow is withdrawn from the flow of low pressure nitrogen which is sucked by the first stage of compressor 7.

Impure nitrogen, constituting the residual gas of the apparatus, is withdrawn at the base of minaret 11A, it is heated at an intermediate temperature in the heat exchange line, it exits from the latter, is expanded at atmospheric pressure in a turbine 5 which ensures cold conditions of the apparatus, then is introduced into the exchange line, it is heated at room temperature, and finally is used to regenerate the bottles of adsorbent material of the apparatus 2 and withdrawn from the apparatus via duct 26.

Oxygen under 65 bars is produced in the following manner.

The desired flow of liquid oxygen is withdrawn at the bottom of column 11, it is pressurized by pump 6 to an intermediate pressure of oxygen, it is vaporized and heated at room temperature in exchange line 3, and is then compressed at a production pressure by means of compressor 8.

In order to have a maximum limit of the thermodynamic irreversibilities in the exchange line, steps are taken so that the vaporization of liquid oxygen under the intermediate pressure of oxygen be carried out by condensation of nitrogen under the elevated cycle pressure, with a sub-critical value for this elevated pressure, for example 30 bars. This value corresponds to a vaporization of liquid oxygen under about 11 bars, which is therefore the pressure provided by pump 6.

The above considerations give pressures for the various stages of the compressor 7: 2.5 bars at the inlet of the first stage, 11 bars at the inlet of second stage, 30 bars at the inlet of the third stage and 55 bars at the outlet of this third stage.

It can be shown that the process described above results in an increase of investment costs, as compared to the known process where the low pressure is selected to be slightly higher than 1 bar, as soon as the flow of nitrogen produced is at least equal to 20% of the flow of air being treated. When the production of nitrogen is higher than about 30% of the air flow, it additionally represents a gain of energy. On the other hand, the fact of purifying the air which is introduced under 11 bars is very advantageous on a cost point of view.

We claim:

1. Process for the simultaneous production on the one hand of pure nitrogen at an elevated pressure which is higher than about 25 bars absolute, and on the other hand of oxygen, by air distillation in a double distillation column, comprising a mean pressure column and a low pressure column providing pure nitrogen at the top of said low pressure column, comprising the steps of withdrawing nitrogen from the low pressure column, heating the withdrawn nitrogen, compressing the heated nitrogen at elevated pressure by means of a single nitrogen compressor of the centrifugal type having at most six compression wheels, and operating the low pressure column at a pressure of the order of $P_N/\rho_N$, where $P_N$ represents the elevated pressure of said nitrogen and $\rho_N$ the compression ratio of said nitrogen compressor.

2. Process according to claim 1, in which oxygen is produced under an elevated pressure which is higher than about 10 bars absolute, and further comprising the steps of withdrawing liquid oxygen from the bottom of the low pressure column by means of a pump to bring the withdrawn oxygen to an intermediate pressure, vaporizing and heating the pumped oxygen, compressing the heated oxygen to an elevated oxygen pressure by means of a single oxygen compressor of the centrifugal type having at most six compression wheels, wherein the intermediate pressure of said oxygen being of the order of $P_o/\rho_o$, where $P_o$ represents the elevated pressure of the oxygen and $\rho_o$ the compression ratio of said oxygen compressor.

3. Process according to claim 2, wherein the nitrogen compressor is a three stage nitrogen compressor, each having at most two wheels, and additionally the second stage is used to compress at an intermediate pressure between the mean pressure and the elevated pressure a flow of cycle nitrogen withdrawn from the mean pressure column, and further comprising the steps of heating said flow of cycle nitrogen, cooling and liquefying the compressed cycle nitrogen, expanding the cooled and liquified nitrogen at mean pressure and introducing the expanded nitrogen at the top of the mean pressure column.

4. Process according to claim 3, wherein the cycle nitrogen is compressed at a sub-critical pressure at which the condensation temperature of nitrogen is slightly higher than the vaporization temperature of oxygen at said intermediate pressure of oxygen.

5. Process according to claim 1, wherein said nitrogen compressor is a three stage nitrogen compressor, each stage having at most two wheels, and additionally the first two stages are used to compress a flow of nitrogen from said low pressure to a pressure which is intermediate between the mean pressure and the elevated pressure, said flow of nitrogen being withdrawn from the top of said low pressure column and heated, and further comprising the steps of cooling, liquefying and expanding to the mean pressure the compressed nitrogen, and introducing the expanded nitrogen at the top of the mean pressure column.

6. Process according to claim 1, further comprising the steps of expanding, in a turbine, impure nitrogen withdrawn from the low pressure column, and using the expanded impure nitrogen to regenerate bottles of adsorbent material used for purifying treated air.

7. Apparatus for the simultaneous production on the one hand of pure nitrogen at an elevated pressure which is higher than about 25 bars absolute, and on the other hand oxygen, by air distillation in a double distillation column comprising a mean pressure column and a low pressure column to produce pure nitrogen at the top of said low pressure column, which comprises an air compressor adapted to bring air to be treated to a mean pressure which is higher than 6 bars absolute, and a single nitrogen compressor of the centrifugal type having at most six compression wheels, to compress nitrogen to an elevated pressure, the first wheel having a suction side connected to the top of the low pressure column, said low pressure column operating at a low pressure of the order of $P_N/\rho_N$, where $P_N$ represents the elevated pressure of said nitrogen and $\rho_N$, the compression ratio of said nitrogen compressor.

8. Apparatus according to claim 7, in which oxygen is produced at an elevated pressure higher than about 10 bars absolute, and further comprising a pump for liquid oxygen having a suction side connected to a vat of the low pressure column and having a discharge connected to the suction side of a single oxygen compressor of the centrifugal type having at most six compression wheels.

9. Apparatus according to claim 8, wherein the nitrogen compressor includes three stages, each having at most two wheels, the second stage having a suction side and a discharge, both connected to the top of the mean pressure column to define a nitrogen cycle.

10. Apparatus according to claim 9, further comprising a common power source connected to the nitrogen compressor and the air compressor.

11. Apparatus according to claim 7, further comprising a turbine for expanding impure nitrogen and having an inlet connected to the low pressure column and an exhaust connected to bottles of adsorbent material used for the purification of the air being treated.

* * * * *